US009810002B2

(12) United States Patent
Hill

(10) Patent No.: US 9,810,002 B2
(45) Date of Patent: Nov. 7, 2017

(54) ROTARY CABLE LATCH

(71) Applicant: Carrier Corporation, Farmington, CT (US)

(72) Inventor: Matthew S. Hill, Sublimity, OR (US)

(73) Assignee: Carrier Corporation, Farmington, CT (US)

( * ) Notice: Subject to any disclaimer, the term of this patent is extended or adjusted under 35 U.S.C. 154(b) by 79 days.

(21) Appl. No.: 14/597,833

(22) Filed: Jan. 15, 2015

(65) Prior Publication Data

US 2015/0203265 A1 Jul. 23, 2015

Related U.S. Application Data

(60) Provisional application No. 61/928,630, filed on Jan. 17, 2014.

(51) Int. Cl.
*E05B 65/52* (2006.01)
*E05B 19/00* (2006.01)
*E05B 73/00* (2006.01)

(52) U.S. Cl.
CPC ..... *E05B 65/52* (2013.01); *E05B 19/0005* (2013.01); *E05B 73/0005* (2013.01); *Y10T 70/437* (2015.04)

(58) Field of Classification Search
CPC .. E05B 65/52; E05B 19/0005; E05B 73/0005; Y10T 70/437
USPC ..... 70/63, 30, 49, 53, 233
See application file for complete search history.

(56) References Cited

U.S. PATENT DOCUMENTS

| | | | | |
|---|---|---|---|---|
| 539,397 A | | 5/1895 | Goodhue | |
| 1,384,590 A | * | 7/1921 | Bottone | E05B 67/063 200/82 R |
| 1,679,665 A | | 8/1928 | Junkunc | |
| 3,967,479 A | | 7/1976 | Vick | |
| 4,064,716 A | * | 12/1977 | Shwayder | E05B 67/22 70/38 A |
| 4,545,224 A | * | 10/1985 | Zane | E05B 71/00 70/233 |
| 4,641,505 A | * | 2/1987 | Maurice | E05B 19/0005 70/162 |
| 4,665,724 A | | 5/1987 | Sakai | |
| 4,838,052 A | * | 6/1989 | Williams | E05B 19/0005 109/52 |

(Continued)

FOREIGN PATENT DOCUMENTS

| | | | |
|---|---|---|---|
| DE | 202008003590 | | 3/2008 |
| EP | 2388418 | | 5/2010 |
| JP | 2006348714 A | * | 12/2006 |

*Primary Examiner* — Suzanne Barrett
(74) *Attorney, Agent, or Firm* — Cantor Colburn LLP

(57) ABSTRACT

A lock box is provided including a base plate. A back cover is mounted to the base plate and includes a first internal compartment. A first end of a connector is mounted within the first internal compartment and a second end of the connector, including an inlet, is selectively retained within the first internal compartment. A retention mechanism is configured to rotate between an unlatched and a latched position to selectively retain the second end of the connector. A front cover coupled to the base plate is movable between a closed and open position. When the front cover is in the closed position, the front cover limits movement of the retention mechanism between the latched and unlatched positions.

18 Claims, 8 Drawing Sheets

(56) References Cited

U.S. PATENT DOCUMENTS 4,949,564 A * 8/1990 Barzilai ..... E05B 67/063 70/39
4,987,753 A * 1/1991 Kuo ..... E05B 67/10 70/39
5,060,491 A * 10/1991 Smith ..... E05B 19/0005 70/14
5,331,830 A * 7/1994 Su ..... E05B 67/063 70/38 A
5,406,812 A * 4/1995 Jaw ..... E05B 67/063 70/233
5,568,740 A * 10/1996 Lin ..... E05B 67/003 70/18
5,992,187 A 11/1999 Derman
6,026,664 A * 2/2000 Lin ..... E05B 67/003 70/18
6,116,663 A * 9/2000 Robert ..... A61G 17/02 27/DIG. 1
6,152,499 A * 11/2000 Robert ..... A61G 17/02 27/DIG. 1
6,609,399 B1 8/2003 Daniels, Jr.
6,923,027 B1 8/2005 Kuo
7,013,686 B1 * 3/2006 Chen ..... E05B 67/063 70/233
7,287,303 B2 10/2007 Yang
7,661,280 B1 2/2010 Weyland
8,578,743 B2 11/2013 Yu
2002/0194887 A1 * 12/2002 Chang ..... E05B 67/063 70/38 B
2004/0154359 A1 * 8/2004 Jakubowski ..... E05B 17/2088 70/63
2004/0226325 A1 * 11/2004 Ling ..... E05B 19/0005 70/63
2005/0044910 A1 3/2005 Sloan
2005/0092037 A1 5/2005 Meekma et al.
2006/0213237 A1 * 9/2006 Yang ..... E05B 19/0005 70/63
2007/0180873 A1 * 8/2007 Yen ..... A45C 13/18 70/63
2011/0079056 A1 * 4/2011 Sakai ..... E05B 19/0005 70/52

* cited by examiner

ROTARY CABLE LATCH

CROSS-REFERENCE TO RELATED APPLICATION

This application claims the benefit of U.S. provisional patent application Ser. No. 61/928,630 filed Jan. 17, 2014, the entire contents of which are incorporated herein by reference.

BACKGROUND OF THE INVENTION

The invention relates generally to access control devices, more particularly, to a lock box which allows selective access to an internal cavity thereof so that various users can be provided key access while maintaining a high level of security.

Lock boxes are known and commonly include a connector or shackle for securing the lock box to an object. Each lock box includes an internal compartment for storing one or more objects. Lock boxes are commonly used in real estate applications where numerous agents require access to a single lock, but it is not cost effective to provide all agents with a key to that lock.

Referring now to the portion of a prior art lock box 10 illustrated in FIGS. 1 and 2, a first end 14 of the connector 12 is secured to a portion of the lock box 10 and a second end 16 of the connector 12 is removably coupled to a portion of the lock box 10 to secure the lock box 10 to an object. The second end 16 of the connector 12 is commonly retained using a spring loaded, push button retention mechanism 20. To release the second end 16 of the connector 12, an operator applies a force to the push button 22 of the retention mechanism 20. The force of the spring 24, generated by the push button 22, causes the retention mechanism 20 to slide generally axially and release the second end 16 of the connector 12 from within an opening 26.

It has been determined that such spring loaded push button retention mechanisms can possibly be subjected to inadvertent opening during an act of vandalism, such as by applying hammer blows to the housing to overcome the spring force of the retention mechanism. Thus, there is a need for a new and improved lock box retention mechanism which overcomes such difficulties.

BRIEF DESCRIPTION OF THE INVENTION

According to an aspect of the invention, a lock box is provided including a base plate. A back cover is mounted to the base plate and includes a first internal compartment. A first end of a connector is mounted within the first internal compartment and a second end of the connector, including an inlet, is selectively retained within the first internal compartment. A retention mechanism is configured to rotate between an unlatched and a latched position to selectively retain the second end of the connector. A front cover coupled to the base plate is movable between a closed and open position. When the front cover is in the closed position, the front cover limits movement of the retention mechanism between the latched and unlatched positions.

According to another embodiment of the invention, a method of releasing an end of a looped connector, the end including an inlet from a retention mechanism of a lock box is provided. The lock box includes a base plate and a back cover mounted to the base plate and including a first internal compartment. A front cover is coupled to the base plate and is movable between a closed position and an open position.

The front cover includes a locking mechanism configured to control movement of the front cover. The locking mechanism is movable between a locked position and an unlocked position. The method includes unlocking the locking mechanism and moving the front cover to the open position. The retention mechanism is rotated from a latched position to an unlatched position, and a force is applied to the connector.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION OF THE INVENTION

Figure 1:
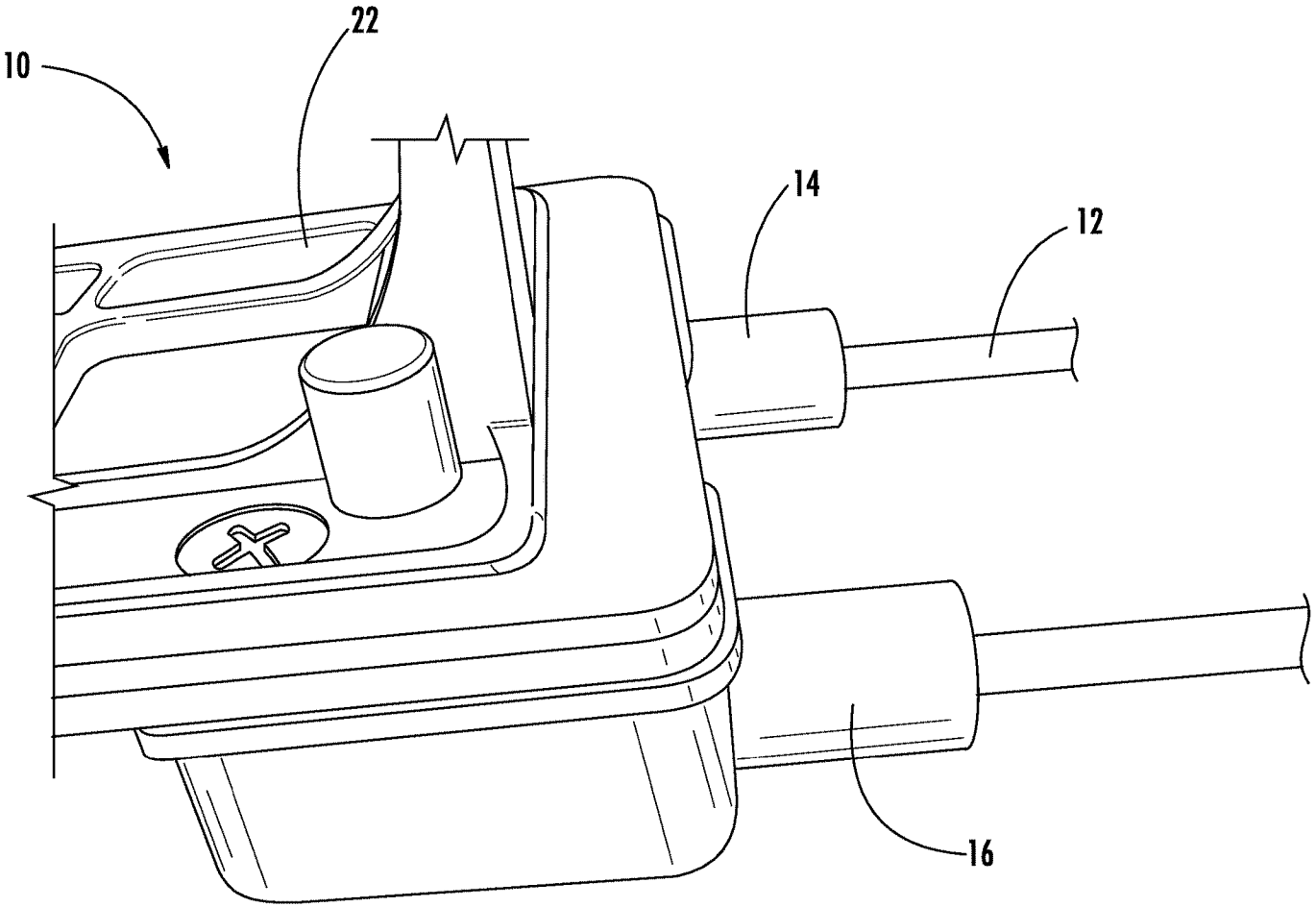
FIG. 1 PRIOR ART
FIG. 1 is a perspective view of a portion of a known lock box.
Figure 2:
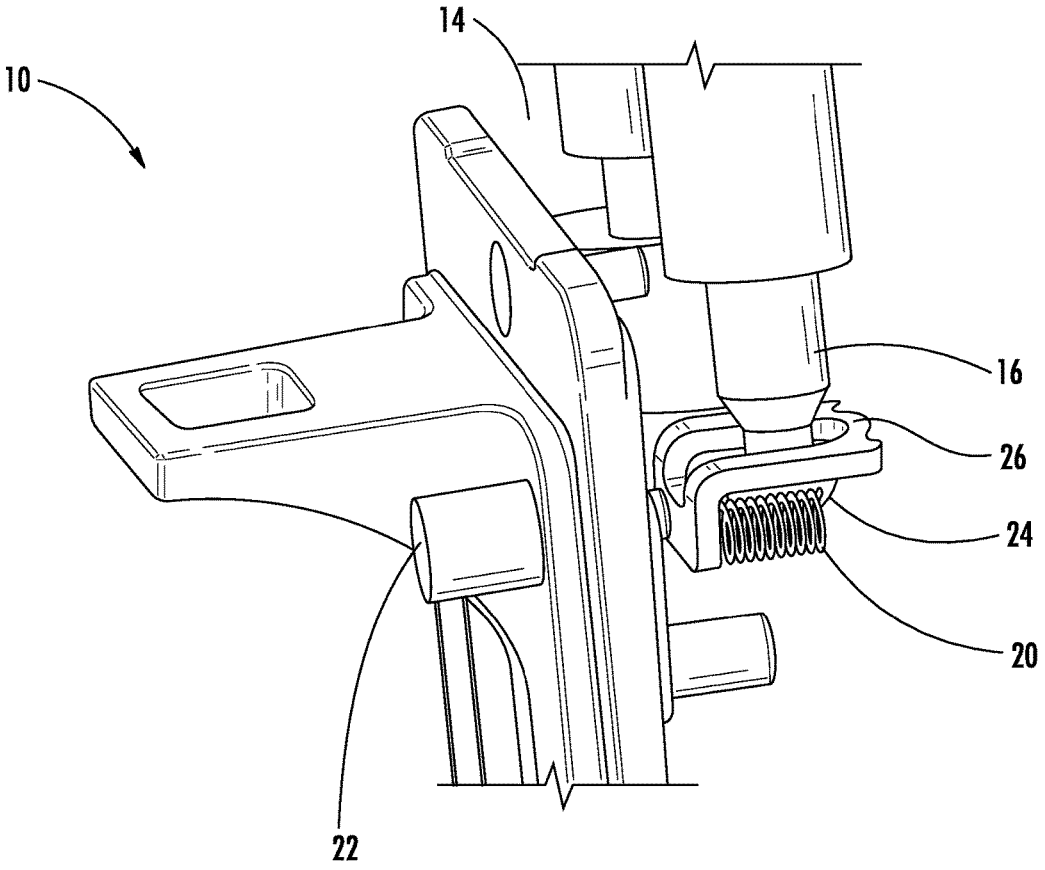
FIG. 2 PRIOR ART
FIG. 2 is a perspective view of a latching mechanism of the known lock box of FIG. 1.
Figure 3:
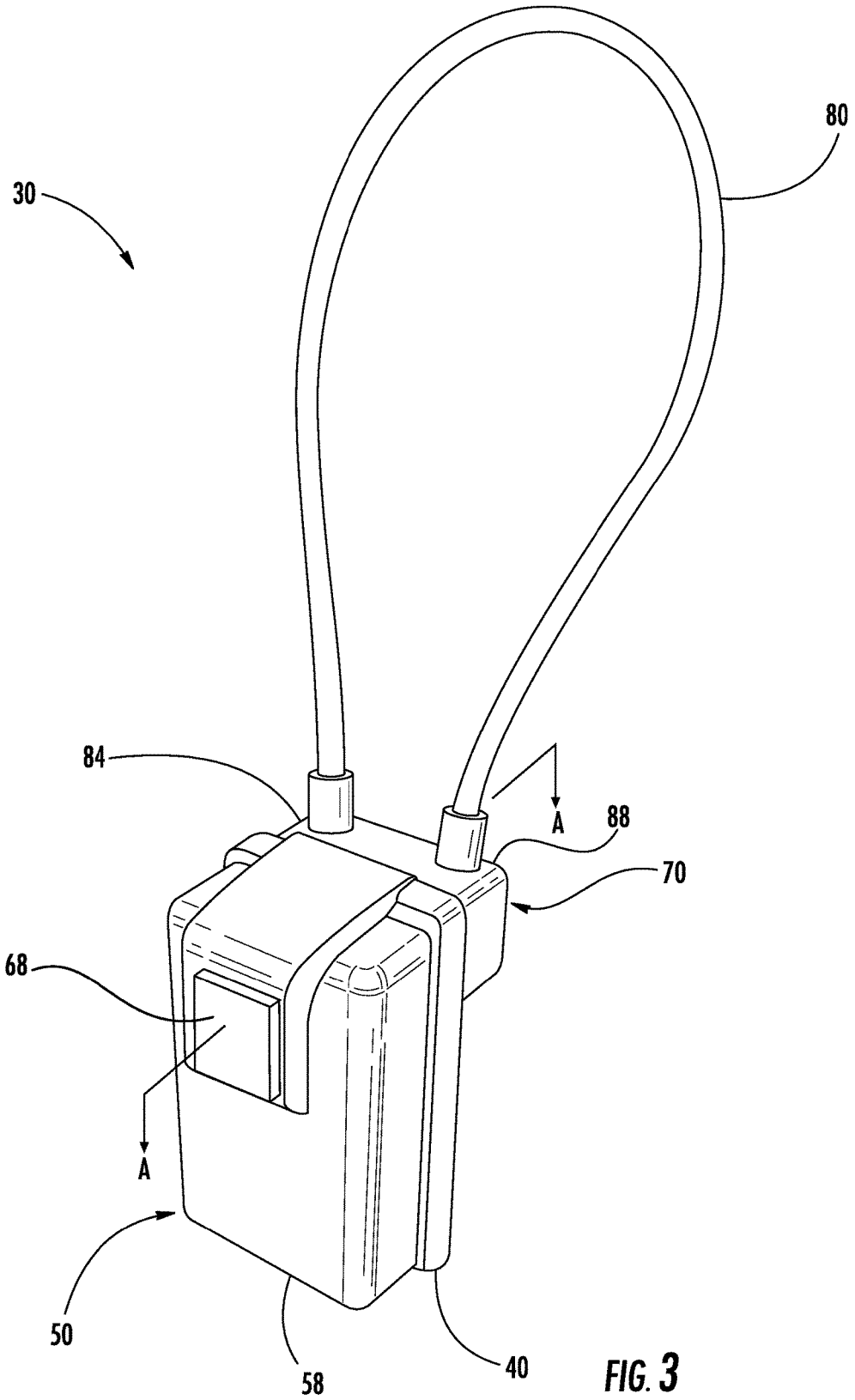
FIG. 3 is a perspective view of a lock box according to an embodiment of the invention.

Referring now to FIG. 3-8, an example of a lock box 30 including a base plate 40, front cover 50, and back cover 70 of an exemplary embodiment is illustrated. In one embodiment, the front cover 50, base plate 40, and back cover 70 are fabricated at least partially from the same metal material, such as aluminum for example. The base plate 40 is generally rectangular in shape and includes a first connection member 44 extending perpendicularly from a first planar surface 42 of the base plate 40. The first connection member 44 may be integrally formed with the first planar surface 42, or alternatively, may be coupled to the first planar surface 42, such as with one or more fasteners for example.

The front cover 50 is generally similar in size and shape to the base plate 40 and is operably coupled thereto. In the illustrated non-limiting embodiment, a bottom edge 52 of the front cover 50 is pivotally coupled to an adjacent bottom edge 46 of the base plate 40, such as with a hinge 54 for example, such that the front cover 50 is movable between a closed position (FIG. 4) and an open position (FIG. 5). However, other coupling mechanisms configured to couple a portion of the base plate 40 and the front cover 50, such as adjacent side surfaces thereof for example, are within the scope of the invention. The front cover 50 includes an internal cavity 56 or compartment configured to store one or more items (not shown). Exemplary items include, but are not limited to, keys, business cards, and written messages for example.

Extending through an opening (not shown) in a front surface 58 of the front cover 50, into the internal cavity 56, is a locking mechanism 60. In one embodiment, the locking mechanism 60 is a mechanical locking mechanism including a lock cylinder 62 configured to receive a complementary key; however other locking mechanisms 60 are within the scope of the invention. In the illustrated, non-limiting embodiment, the locking mechanism 60 includes a lock cam 64 extending from and generally perpendicular to the axis B of the lock cylinder 62. The lock cam 64 is configured to move with the lock cylinder 62 between a locked position and an unlocked position. For example, when a corresponding key is inserted into the lock cylinder 62 and rotated about axis B, together the lock cylinder 62 and lock cam 64 move between the locked position and the unlocked position.

Figure 4:
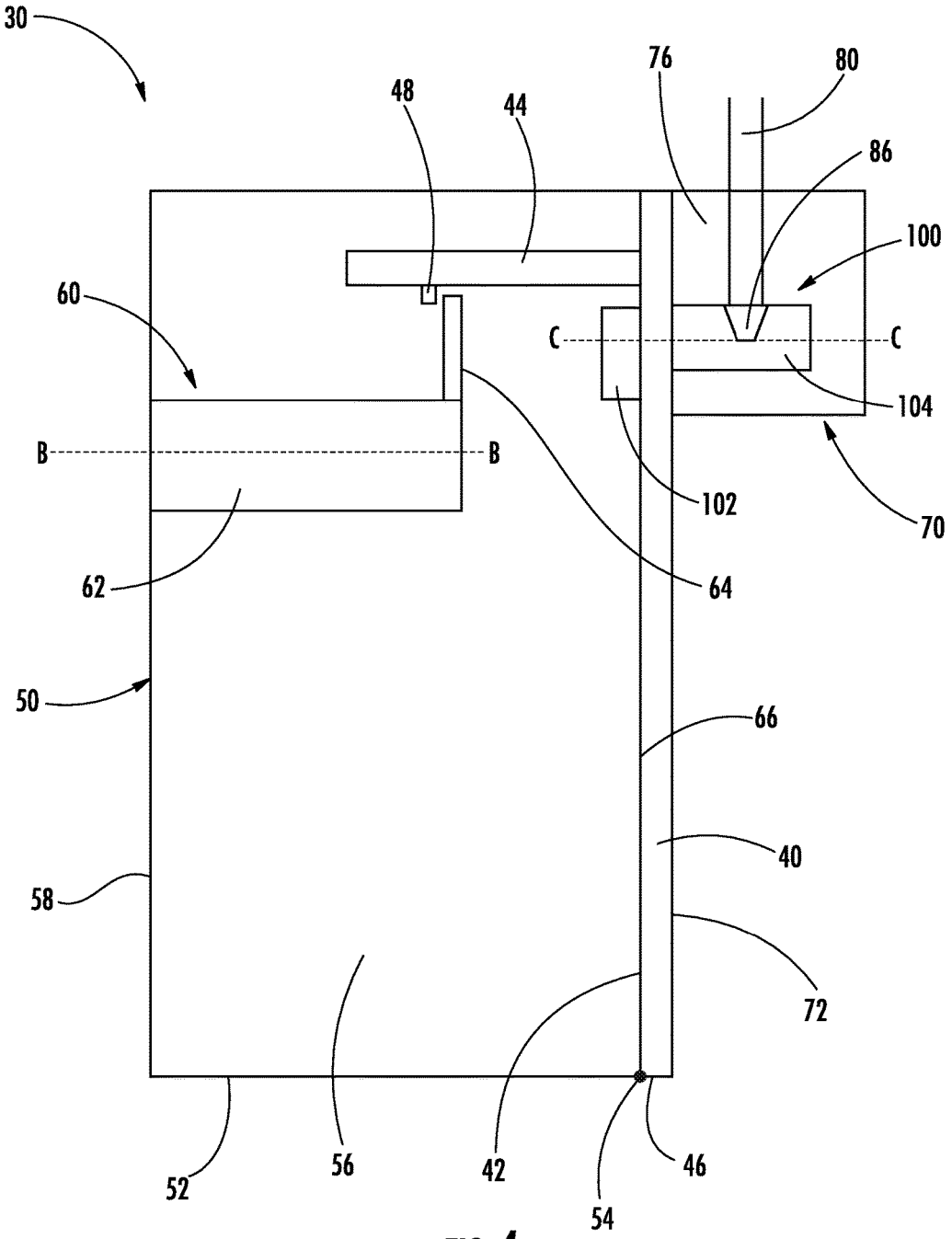
FIG. 4 is a cross-sectional view of the lock box of FIG. 3, taken along line A-A.
Figure 5:
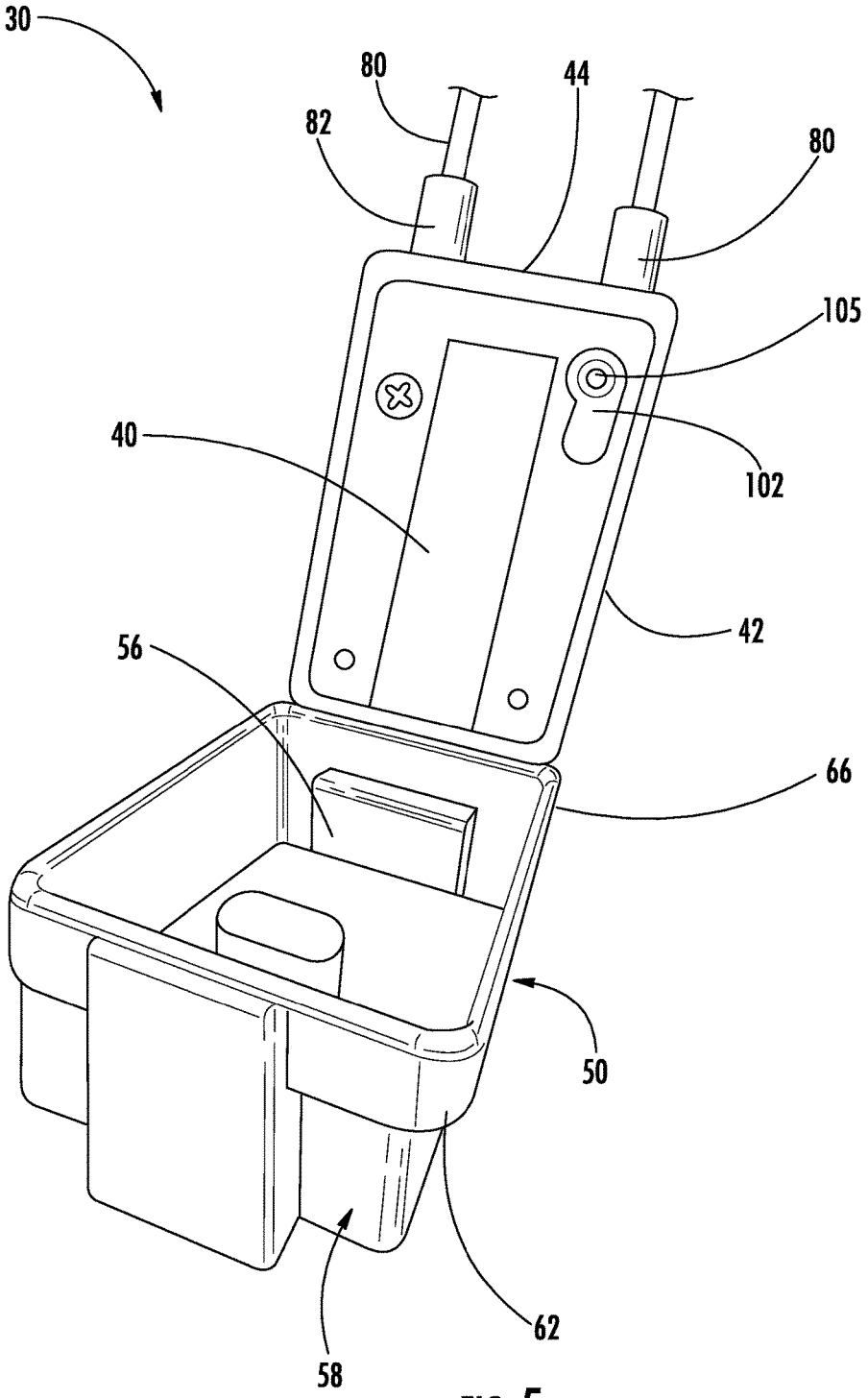
FIG. 5 is a perspective view of a lock box having an open front cover and a latched latching mechanism according to an embodiment of the invention.
Figure 6:
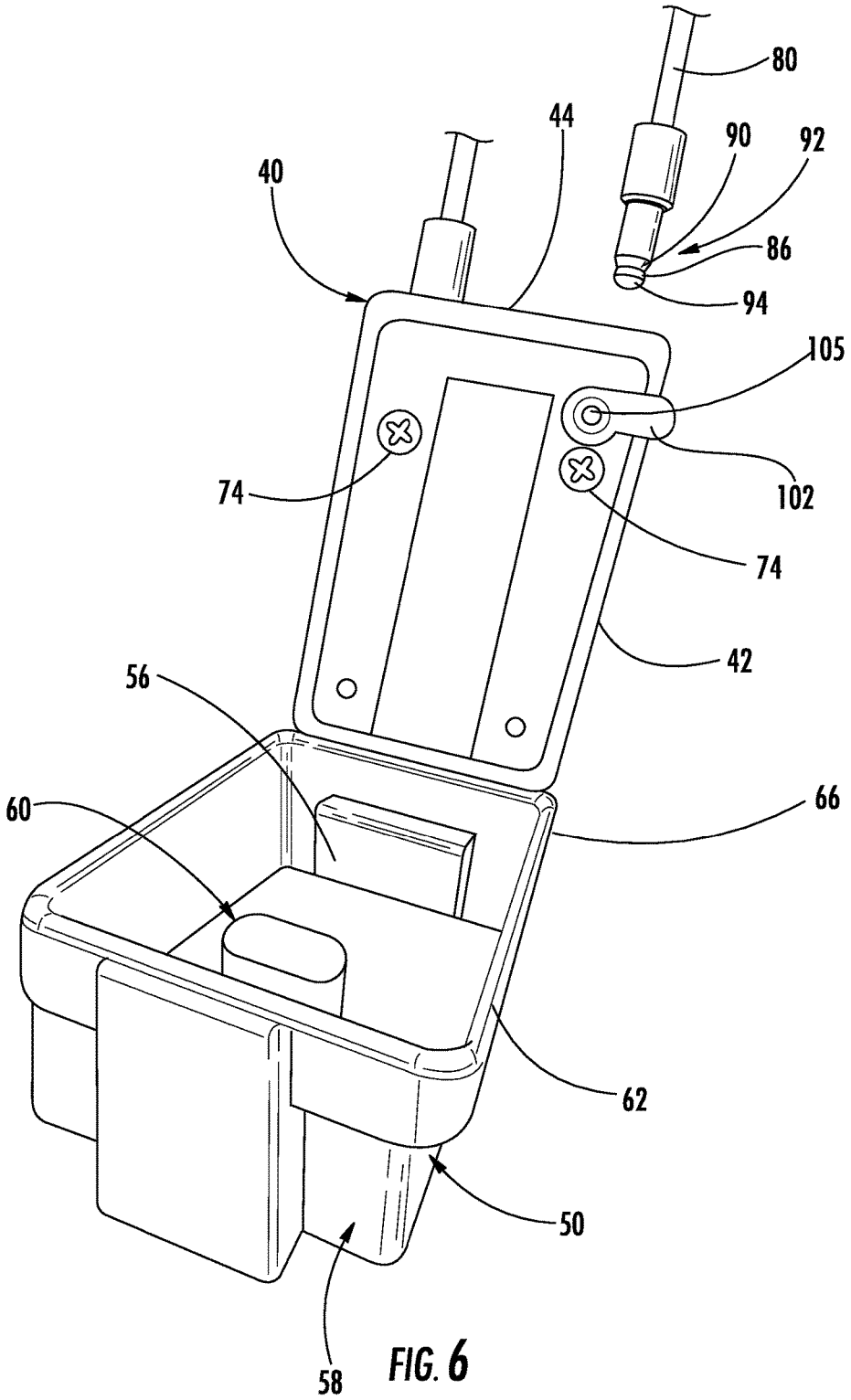
FIG. 6 is a perspective view of a lock box having an open front cover and an unlatched latching mechanism according to an embodiment of the invention.

In the closed position, a back surface 66 of the front cover 50 is arranged generally adjacent the first planar surface 42 of the base plate 40 and the lock cam 64 of the locking mechanism 60 is generally aligned with a contact portion 48 of the first connection member 44 (see FIG. 4). When the lock cam 64 is in the locked position, the lock cam 64 is arranged generally vertically and is configured to engage the contact portion 48. In one embodiment, the contact portion 48 includes a protrusion extending generally downward from the first connection member 44. In another embodiment, the contact portion 48 includes an opening within which the free end of the lock cam 64 is received. This connection between the lock cam 64 and the contact portion 48 limits movement of the cover plate 50 relative to the base plate 40. Only once the lock cam 64 is rotated to the unlocked position and out of contact with the contact portion 48 of the first connection member 44 may the front cover 50 be pivoted to the open position to expose the internal cavity 56 and any items disposed therein.

In one embodiment, a flap 68 (see FIG. 3) is coupled to the front surface 58 of the front cover 50, adjacent the opening (not shown) and an end of the locking mechanism 60. The flap 68 is movable between a closed position and an open position to selectively provide access to the locking mechanism 60. In one embodiment, the flap 68 is pivotally coupled to the front cover 58 with a pin or hinge (not shown). Inclusion of the flap 68 prevents dirt and debris from entering the locking mechanism 60 when the lock box 30 is not in use.

The back cover 70 is generally smaller in size than the base plate 40, and is mounted to a second planar surface 72 of the base plate 40, such as with a plurality of fasteners 74 for example. Similar to the front cover 50, the back cover 70 also includes an internal cavity or compartment 76. A portion of a connector 80 configured to secure the lock box 30 to an object (not shown), such as a door knob or steering wheel for example, is generally arranged within the compartment 76 of the back cover 70. Examples of a connector 80 include, but are not limited to a cable or a shackle for example. A first end 82 of the connector 80 is mounted within the compartment 76, such that the connector 80 extends outwardly through a first hole 84 in the back cover 70. A second end 86 of the connector 80 is configured to extend through a second hole 88 in the back cover 70 to removably couple to a portion of a retention mechanism 100 arranged within the compartment 76. When the second end 86 of the connector 80 is attached to the retention mechanism 100, the connector 80 forms a loop extending from the back cover 70. The second end 86 of the connector 80 generally includes an inlet 90 having a reduced cross-sectional area. In the illustrated, non-limiting embodiment, the connector 80 is a cable having a latching mechanism 92 attached to the second end 86 and configured to selectively couple to the retention mechanism 100. The latching mechanism 92 includes an first section 94 adjacent the inlet 90 (see FIGS. 6 and 7), the first section 94 having a cross-sectional area greater than that of the inlet 90.

Figure 7:
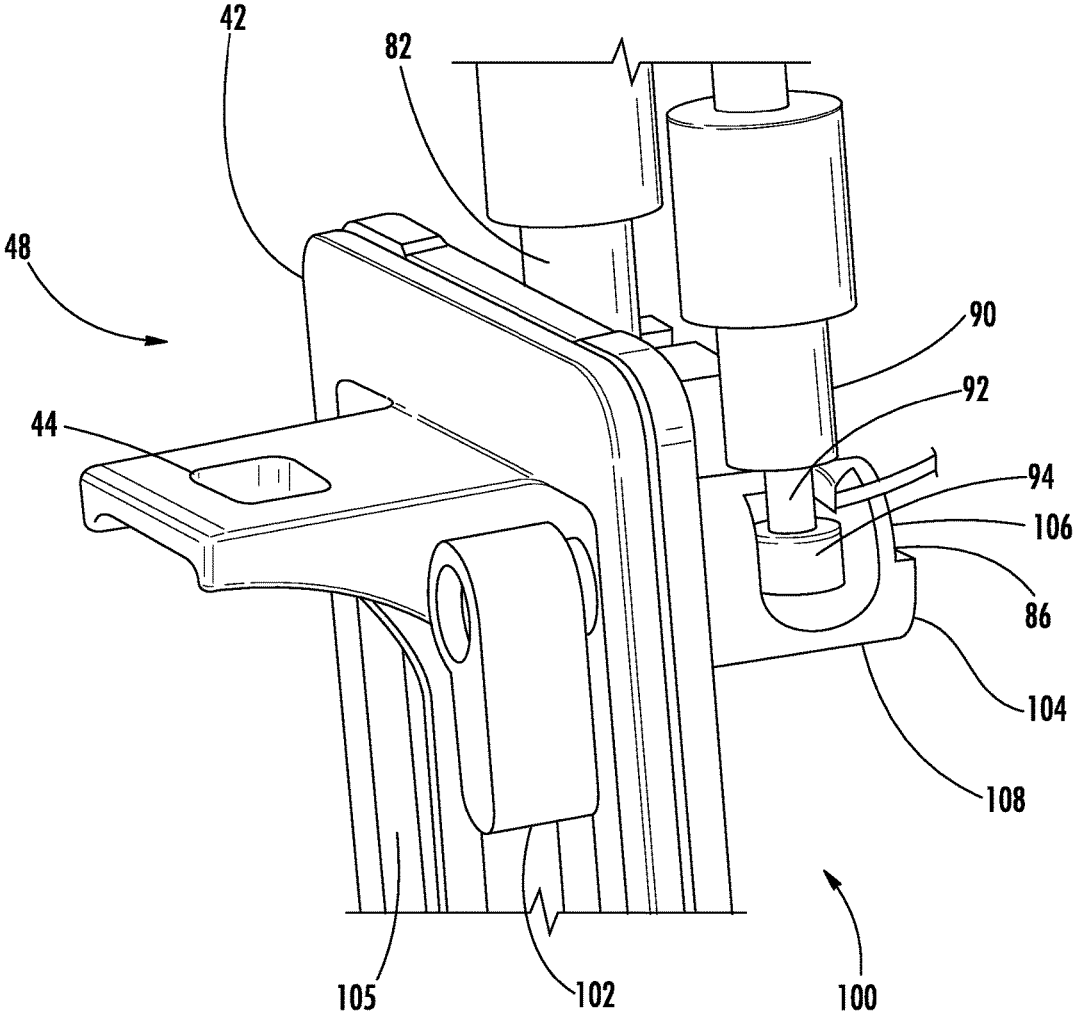
FIG. 7 is a perspective view of a latching mechanism in a latched position according to an embodiment of the invention.
Figure 8:
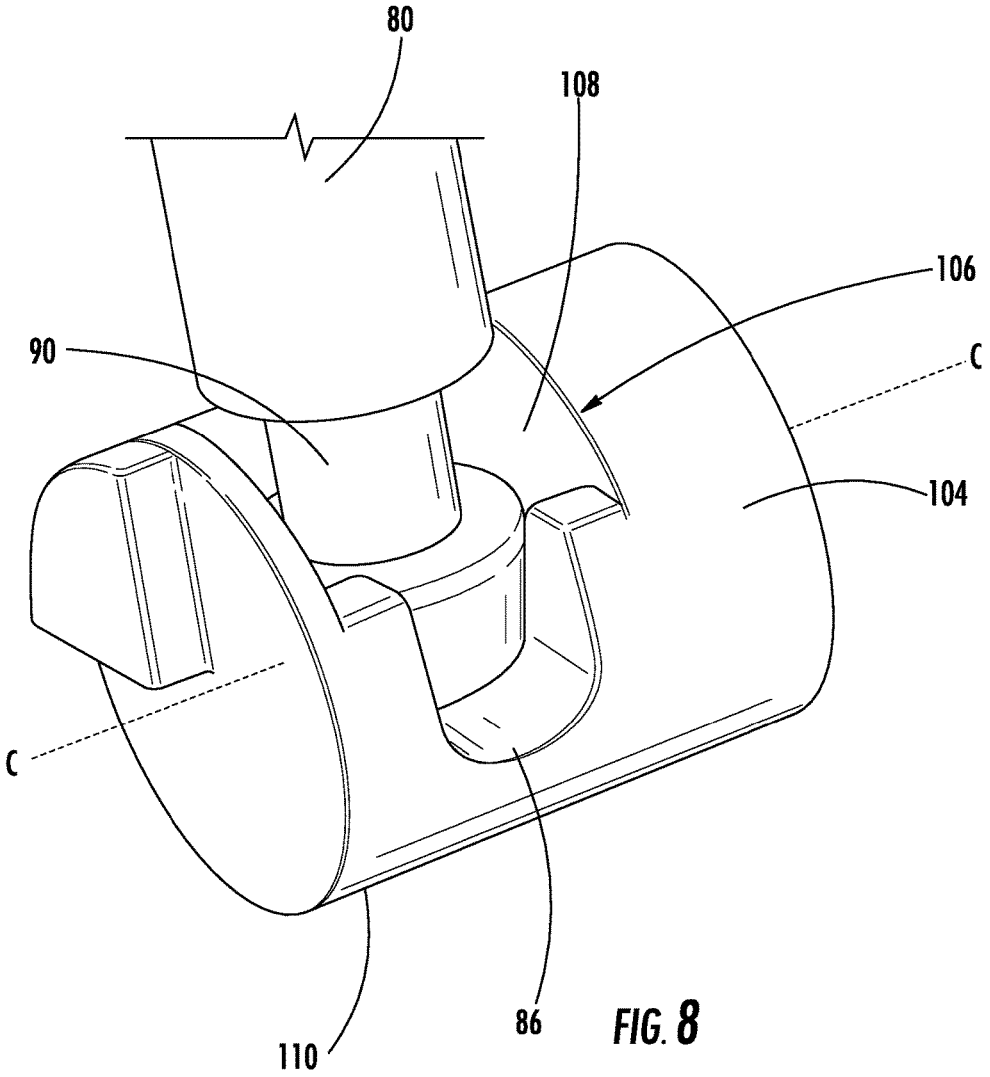
FIG. 8 is a perspective view of a latching mechanism in an unlatched position according to an embodiment of the invention.

The retention mechanism 100 configured to selectively retain the second end 86 of the connector 80 is illustrated in more detail in FIGS. 7 and 8. The retention mechanism 100 includes a knob 102 arranged adjacent the first planar surface 42 of the base plate 40 and a cylinder 104 arranged generally within the compartment 76 adjacent the second planar surface 72 of the base plate 40. A portion of either the knob 102 or the cylinder 104 extends through an opening (not shown) in the base plate 40 so that the knob 102 and the cylinder 104 may be coupled with a fastener 105. The cylinder 104 of the retention mechanism 100 is generally hollow and has an opening 106 formed partially about the circumference thereof. The opening 106 is generally non-uniform about the circumference and includes a first portion 108 complementary to the second end 86 of the connector 80 and a second portion 110 complementary to the inlet 90 of the second end 86 of the connector 80.

The retention mechanism 100 is rotatable about an axis C between a latched position (FIG. 7) and an unlatched position (FIG. 8). When the retention mechanism 100 is in the unlatched position, the knob 102 is arranged generally horizontally relative to the base plate 40 and the first portion 108 of the opening 106 is positioned adjacent the second hole 88 in the back cover 70. When the retention mechanism 100 is in the latched position, the second portion 110 of the opening 106 is located adjacent the second hole 88 in the back cover 70. The front cover 50 may only be moved from the open position to the closed position when the retention mechanism 100 is in the latched position, and the knob 102 of the retention mechanism 100 may only be rotated from the latched position to the unlatched position when the front cover 50 is in an open position.

To attach the lock box 30 to an object, the connector 80 is looped around the object and the second end 86 of the connector 80 is inserted through the second hole 88 and into the first portion 108 of the opening 106 of the cylinder 104. The knob 102 of the retention mechanism 100 is then rotated from the unlatched position to the latched position. When the knob 102 is rotated, the cylinder 104 rotates relative to the second end 86 of the connector 80 so second portion 110 of the opening 106 receives the inlet 90 of the second end 86. Because the second end 86 of the connector 80 is larger than the second portion 110 of the opening 106, the second end 86 is retained within the cylinder 104. To release the connector 80, the cylinder 104 is rotated back to the unlatched position, via knob 102, so that when a force is applied to the connector 80, the second end 86 of the connector 80 may pass freely through the aligned first portion 108 of the opening 106 and the second hole 88 of the back cover 70.

By using a rotatable retention mechanism 100 to retain the second end 86 of the connector 80, the front cover 50 of the lock box 30 limits unintended rotation of the the knob 102, and therefore the retention mechanism 100. As a result, application of a force, such as by a vandal for example, will be insufficient to release the second end 86 of the connector 80 retained within the cylinder 104 of the retention mechanism 100.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A lock box comprising:

a base plate;

a back cover mounted to the base plate, the back cover including a first internal compartment;

a connector configured to connect the lock box to an object, the connector including a first end and a second end, the first end of the connector being mounted within the first internal compartment, and the second end of the connector being selectively retained within the first internal compartment, wherein the second end of the connector includes an inlet;

a retention mechanism coupled to the base plate and including an opening for receiving the second end of the connector, the retention mechanism being configured to rotate between an unlatched and a latched position to selectively retain the second end of the connector; and a front cover coupled to the base plate, the front cover being movable between a closed position and an open position, wherein when the front cover is in the closed position, engagement between the front cover and the retention mechanism restricts movement of the retention mechanism between the latched position and the unlatched position.

2. The lock box according to claim 1, wherein a cross-sectional area of the inlet is reduced relative to the second end.

3. The lock box according to claim 2, wherein the retention mechanism includes a coupled knob and cylinder, the knob being positioned adjacent a first surface of the base plate and the cylinder being arranged within the first internal cavity, adjacent and second opposite surface of the base plate.

4. The lock box according to claim 3, wherein the cylinder is generally hollow and the opening formed therein extends partially about a circumference thereof, the opening having a first portion generally complementary to the second end of the connector and a second portion generally complementary to the inlet.

5. The lock box according to claim 4, wherein the second end of the connector is retained by the cylinder when the retention mechanism is in the latched position.

6. The lock box according to claim 1, wherein the front cover comprises a second internal cavity configured to store one or more items.

7. The lock box according to claim 6, further comprising a locking mechanism coupled to the front cover and extending at least partially into the second internal cavity, the locking mechanism being movable between a locked position and an unlocked position.

8. The lock box according to claim 7, wherein the base plate further comprises a connection member extending from a first surface of the base plate such that the locking mechanism is configured to selectively engage a portion of the connection member to limit movement of the front cover between the closed position and the open position.

9. The lock box according to claim 8, wherein the locking mechanism includes:

a lock cylinder configured to rotate about a second axis in response to rotation of a corresponding key; and a lock cam connected to the lock cylinder, the lock cam being configured to contact the connection member when the locking mechanism is in the locked position.

10. The lock box according to claim 9, wherein when the locking mechanism is in the locked position, a free end of the lock cam is received within an opening of the connection member.

11. The lock box according to claim 1, wherein the first end of the connector is mounted within the first internal compartment.

12. The lock box according to claim 1, wherein the front cover and the base plate are pivotally coupled by a hinge.

13. The lock box according to claim 1, wherein the back cover is mounted to the base plate with at least one fastener.

14. The lock box according to claim 1, wherein at least one of the base plate, front cover, and back cover are fabricated from aluminum.

15. A method of releasing an end of a looped connector, the end including an inlet, from a retention mechanism of a lock box, the lock box including a base plate, a back cover mounted to the base plate and including a first internal compartment, a front cover coupled to the base plate, the front cover being movable between a closed position and an open position, the front cover including a locking mechanism configured to control movement of the front cover, the locking mechanism being movable between a locked position and an unlocked position, the method comprising:

unlocking the locking mechanism;

moving the front cover to the open position;

rotating the retention mechanism from a latched position to an unlatched position, wherein when the front cover is in the closed position, engagement between the front cover and the retention mechanism restricts movement of the retention mechanism between the latched position and the unlatched position; and applying a force to the connector to remove the connector from an opening in the receiving mechanism.

16. The method according to claim 15, wherein the locking mechanism is unlocked by inserting and rotating a complementary key.

17. The method according to claim 15, wherein the locking mechanism includes a lock cam configured to selectively engage a contact portion of a connection member mounted to the base plate, and unlocking the locking mechanism disengages the lock cam from the contact portion.

18. The method according to claim 15, wherein the retention mechanism includes a coupled knob and cylinder, the cylinder being generally hollow and having an opening formed partially about a circumference thereof, the opening including a first portion generally complementary to the end of the connector and a second portion generally complementary to the inlet and when the retention mechanism is rotated to the unlatched position, the first portion of the opening is adjacent the end of the connector.

* * * * *